US011097174B2

(12) United States Patent
Paulson et al.

(10) Patent No.: US 11,097,174 B2
(45) Date of Patent: Aug. 24, 2021

(54) MODULAR SELF-RETURNING BATTING TEE

(71) Applicant: HotTEE Enterprises, LLC, Fruita, CO (US)

(72) Inventors: Lanny D. Paulson, Fruita, CO (US); Kenny O. Sackett, Fruita, CO (US); Randall S. Tuell, Grand Junction, CO (US)

(73) Assignee: HotTEE Enterprises, LLC, Fruita, CO (US)

( * ) Notice: Subject to any disclaimer, the term of this patent is extended or adjusted under 35 U.S.C. 154(b) by 0 days.

(21) Appl. No.: 16/013,014

(22) Filed: Jun. 20, 2018

(65) Prior Publication Data

US 2019/0388753 A1 Dec. 26, 2019

(51) Int. Cl.

*A63B 69/00* (2006.01)
*A63B 63/00* (2006.01)
*A63B 102/18* (2015.01)

(52) U.S. Cl.

CPC ..... *A63B 69/0002* (2013.01); *A63B 63/00* (2013.01); *A63B 69/0075* (2013.01); *A63B 69/0091* (2013.01); *A63B 2069/0006* (2013.01); *A63B 2069/0008* (2013.01); *A63B 2102/18* (2015.10); *A63B 2102/182* (2015.10); *A63B 2225/093* (2013.01)

(58) Field of Classification Search

CPC ..... A63B 69/00; A63B 69/0002; A63B 63/00
See application file for complete search history.

(56) References Cited

U.S. PATENT DOCUMENTS

| | | | | | |
|---|---|---|---|---|---|
| 2,126,245 | A * | 8/1938 | Darby | A63B 67/06 | 473/589 |
| 2,976,041 | A * | 3/1961 | White | A63B 69/0075 | 473/417 |
| 2,978,246 | A * | 4/1961 | Van Groningen | A63B 63/00 | 473/456 |
| 3,489,411 | A | 1/1970 | Morelli et al. | | |
| 4,709,924 | A | 12/1987 | Wilson et al. | | |
| 4,819,937 | A | 4/1989 | Gordon | | |
| 4,989,866 | A | 2/1991 | Dill | | |
| 5,004,234 | A | 4/1991 | Hollis | | |
| 5,100,134 | A * | 3/1992 | Becker | A63B 69/0075 | 473/417 |
| 5,255,911 | A * | 10/1993 | Preston | A63B 69/0079 | 473/423 |

(Continued)

*Primary Examiner* — Eugene L Kim
*Assistant Examiner* — Christopher Glenn
(74) *Attorney, Agent, or Firm* — Berg Hill Greenleaf Ruscitti LLP

(57) ABSTRACT

The invention includes apparatus and methods for a novel modular self-returning batting tee. In one preferred embodiment, a modular self-returning batting tee may have one or more extension arms that are compatible with a variety of different batting attachments and/or aids, and may further be secured to a receiver tube positioned within a flexible boot. This receiver tube may be coupled with a weighted base through a novel recoil joint. In this embodiment, when the tee is struck, such as may occur during batting practice, the extension arm may bend forward engaging the flexible boot and/or novel recoil joint and causing the extension arm to self-return to a pre-determined position.

28 Claims, 14 Drawing Sheets

(56) References Cited

U.S. PATENT DOCUMENTS 5,320,343 A * 6/1994 McKinney ..... A63B 69/0075 473/417
5,505,443 A * 4/1996 Padilla ..... A63B 69/0079 473/417
5,916,045 A 6/1999 Busch
7,704,168 B1 * 4/2010 Hochberg ..... A63B 69/0002 473/417
8,821,322 B1 * 9/2014 Jorgens ..... A63B 69/0075 473/417
8,979,681 B1 * 3/2015 Murphy ..... A63B 69/0002 473/417
2002/0091021 A1 * 7/2002 Clabough ..... A63B 63/00 473/454
2005/0130771 A1 * 6/2005 Tsai ..... A63B 69/0002 473/417
2006/0258485 A1 * 11/2006 Bandimere ..... A63B 69/0075 473/417
2006/0264273 A1 * 11/2006 Liao ..... A63B 69/0075 473/417
2007/0275793 A1 * 11/2007 Liao ..... A63B 69/0002 473/417
2008/0064534 A1 * 3/2008 Lortscher ..... A63B 69/0075 473/417
2009/0312123 A1 * 12/2009 Liao ..... A63B 69/0073 473/417
2011/0092317 A1 * 4/2011 Burgess ..... A63B 69/0002 473/417
2012/0165136 A1 * 6/2012 Durham ..... A63B 69/0075 473/417
2012/0264548 A1 * 10/2012 Liao ..... A63B 69/0002 473/417
2014/0243116 A1 * 8/2014 Durham ..... A63B 69/0075 473/417
2014/0296000 A1 * 10/2014 Chen ..... A63B 69/0002 473/417
2014/0302948 A1 * 10/2014 Holland ..... A63B 69/0075 473/417
2015/0165292 A1 * 6/2015 LeBlanc ..... A63B 69/0002 473/454
2016/0303450 A1 * 10/2016 Holland ..... A63B 69/0075
2018/0036615 A1 * 2/2018 Thurber ..... A63B 69/0091

* cited by examiner

MODULAR SELF-RETURNING BATTING TEE

TECHNICAL FIELD

The present invention relates generally to equipment for sports training and play, and in particular an improved batting tee system. Specifically, the invention generally disclosed herein relates to an improved modular self-returning batting tee.

BACKGROUND

Batting tees are well known for use in improving the hitting of baseball and softball players. Traditional batting tees typically have a support member shaped like home plate with a pipe or post extending upwardly and terminating in a flexible piece of rubber upon which a baseball or softball to be hit may be supported in the approximate area of the player's strike zone. The height of the ball upon the tee is usually adjustable to simulate high and low pitches, as well as for use by different sized players.

The performance of such traditional batting tees is limited by the placement of their tee stems. Stationary tees restrict the ball to a single location over the center of the base or home plate. This restriction forces the batter to improperly position his or her feet in relation to home plate and to reposition themselves every time they want to change the direction of ball flight. This limitation encourages poor stance and swing mechanics.

As opposed to traditional stationary batting tees, adjustable posts or "tees" for mounting baseballs or softballs at various heights and plate positions for batting practice are not new in the prior art. However, while these structures, such as the ones disclosed in United States Patents to Dill, Gordon, Hollis and Morelli, et al., U.S. Pat. Nos. 4,989,866; 4,819,937; 5,004,234 and 3,489,411, respectively, have certain advantageous features in their construction and operation, all have a number of limitations and/or shortcomings which are overcome by the design and operation of the present invention.

For example, many of the conventional structures developed to date are cumbersome and are very difficult to adjust and use, especially for the younger players. Many have limited ball-strike positions and generally include fragile, unstable design of the tee structure where a high center of gravity causes the device to be easily toppled and/or damaged during the practice operation. In addition, such traditional adjustable batting tees are not capable of using multiple types of batting attachments that might present the ball in varying orientations.

One major drawback of traditional stationary, and even adjustable tees, involves the inability to maintain positioning through a self-returning mechanism. Without this "self-return" aspect, a hitter will be forced to use individual baseballs placed on top of the tee. Such traditional use is less efficient as the user must constantly collect the errant balls and reposition prior to each practice swing.

A continuing need exists, therefore, for a new and improved batting practice, swing corrector, pitching target teaching aid, which, in combination, overcomes the disabilities, deficiencies and shortcomings of the existing devices while providing for all of the advantages.

SUMMARY OF THE INVENTION

One aim of the invention described herein may include a novel batting tee. In one preferred embodiment, the invention may include a novel modular batting tee. In this embodiment, the invention may be configured to be coupled with a plurality of modular hitting attachments.

Another aim of the current inventive technology may include a novel self-returning batting tee. In one preferred embodiment, a batting tee having one or more extension arms may be coupled with a base through a novel recoil joint. In this embodiment, when struck, such as may occur during batting practice, the extension arm may bend forward engaging the novel recoil joint causing the extension arm to self-return to a pre-determined position. In this configuration, a modular batting attachment having a secure ball may be coupled with an extension arm such that when struck, the extension arm and modular ball attachment may travel forward and engage the recoil joint that anchored to the tee's base and return to its original position. In this manner, the self-returning batting tee is able to reset itself for rapid and continuous use.

Another aim of the invention may include a novel kinetic force absorption system configured to aid in the tee's self-return mechanism. In one embodiment, a flexible boot may be seated within the tee's base and further secured by a circumferential weight which may anchor the base to the ground. One or a plurality of extension arms may be inserted into the flexible boot and further coupled to the base through the recoil joint. In this configuration, when the extension arm, or in a preferred embodiment, a modular batting attachment, is struck, thus transferring a kinetic force energy into the extension arm causing it to bend. In addition to the action of the recoil joint described above, the kinetic force of the extension arm's forward movement is resisted and adsorbed by the flexible boot. The flexible boot further may be made of a resilient material that exerts an opposing force causing the coupled extension arm to return to its original position.

Another aim of the invention may include an adjustable extension arm. In one preferred embodiment, a plurality of extension arms may be nested together in a telescoping manner and may be further be secured at a desired position through one or more extension arm couplers. In another embodiment, such extension arm(s) may be seated in a receiver tube that may further be anchored to the tee's base through the recoil joint.

Another aim of the invention may include a modular pitching attachment that may be coupled with, and/or supported by the tee. In one preferred embodiment, this modular pitching attachment may include a support arm that may be coupled with the base, for example through a receiver tube. This modular pitching attachment may further include a plurality of pitch partitions supported by a pitching frame, which may further be coupled with a tapered net. In this preferred embodiment, the modular batting tee maybe converted into an adjustable pitching system that may include an exemplary strike zone that is divided up into distinct pitch partitions, as well as a tapered net to collect balls that pass through the frame as would occur during pitching practice.

Additional aims of the invention will become apparent through the figures and detailed disclosure below.

DETAILED DESCRIPTION OF THE INVENTION

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

The inventive technology described herein generally relates to a novel batting tee system. In one preferred embodiment, the invention may include a modular self-returning batting tee (1).

In one embodiment, a modular self-returning batting tee (1) may include a base (2) element. As generally shown in FIGS. 9-12, and 16, a base (2) may be a generally planar support member that may lay flat on the ground and provide an initial support structure for the other elements of the modular self-returning batting tee (1). While a variety of shapes and configurations may be contemplated in this invention, in this preferred embodiment, the base may be configured to be several feet in diameter so as to provide a robust base support such that it will naturally resist being tipped or moved when the batting tee is used. This base (2) may be formed from a hard plastic of other composite material as an integral component or maybe assembled from separate distinct parts.

Figure 9:
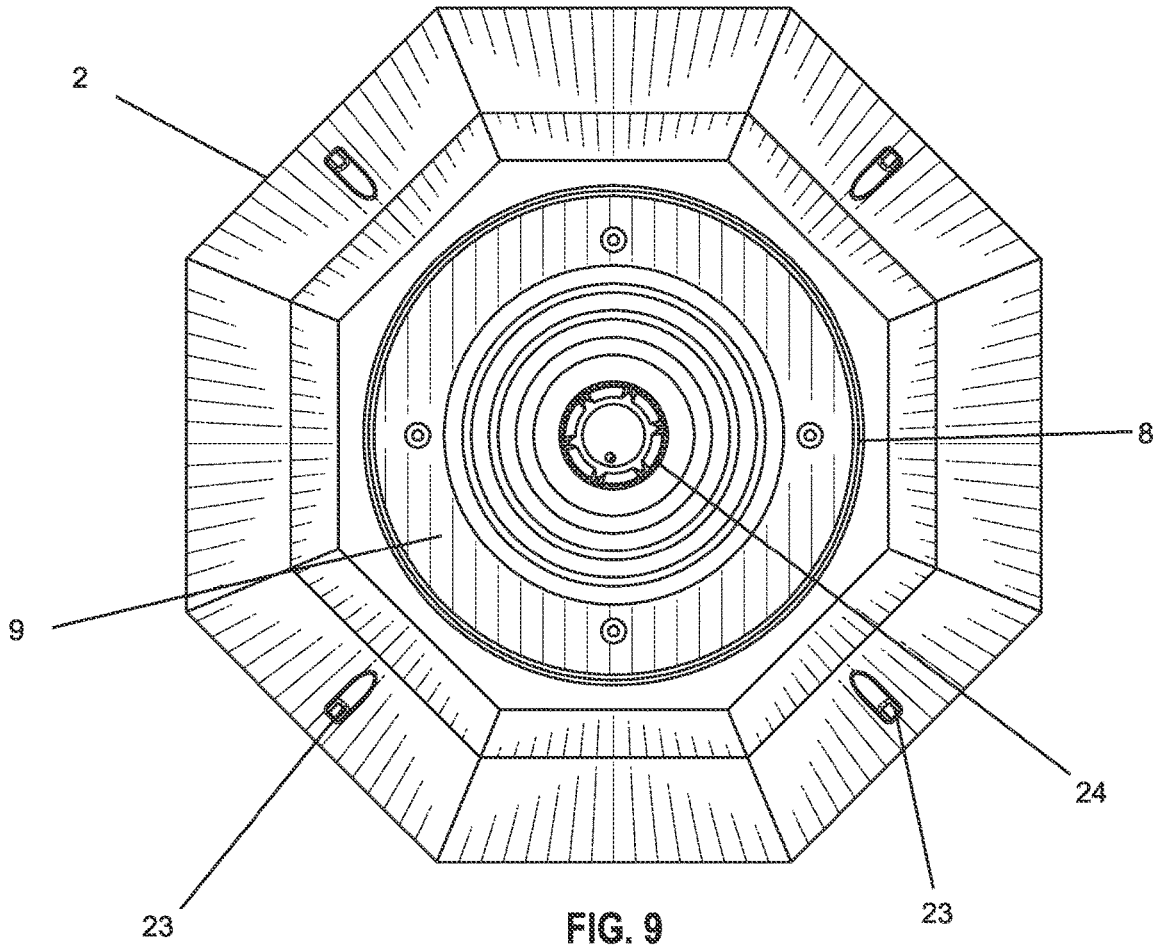
FIG. 9—is a top view of a base and flexible boot coordinated with a circumferential weight in one embodiment thereof.

Generally referring to FIG. 9, in this embodiment a base (2) may include one or more stake apertures (23). Such apertures may be placed in an opposing configuration along the periphery of the base (2) and may further be configured to allow a stake or other similar securing components to pass through the base and be secured in the ground or other surface. In this manner the base (2) may be additionally secured to the ground to help resist being tipped or moved when the batting tee is used.

Figure 11:
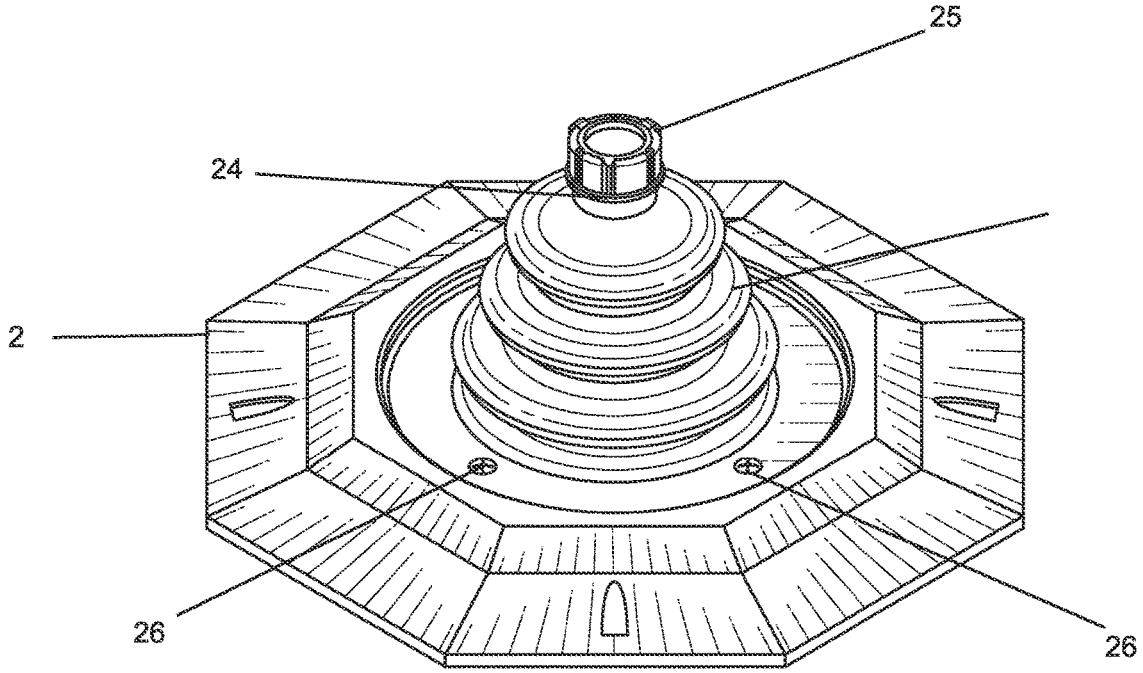
FIG. 11—is a perspective view of a base and flexible boot as well as an extension arm lock and corresponding receiver tube lock in a coupled configuration in one embodiment thereof.

The base (2) may include a base channel (8). As highlighted in FIG. 16, in this preferred embodiment a base channel may include an approximately circular channel configured to receive and secure a flexible boot (3). As shown in FIG. 11, in this embodiment a flexible boot (2) may be positioned within the base channel (8) and secured in place by a circumferential weight (9). In this preferred embodiment a circumferential weight (9) may include a metal, or other weighted ring that may be placed over a base extension (12) on a flexible boot (3) such that the circumferential weight (9) secures the flexible boot (3) in the base channel (8).

Figure 12:
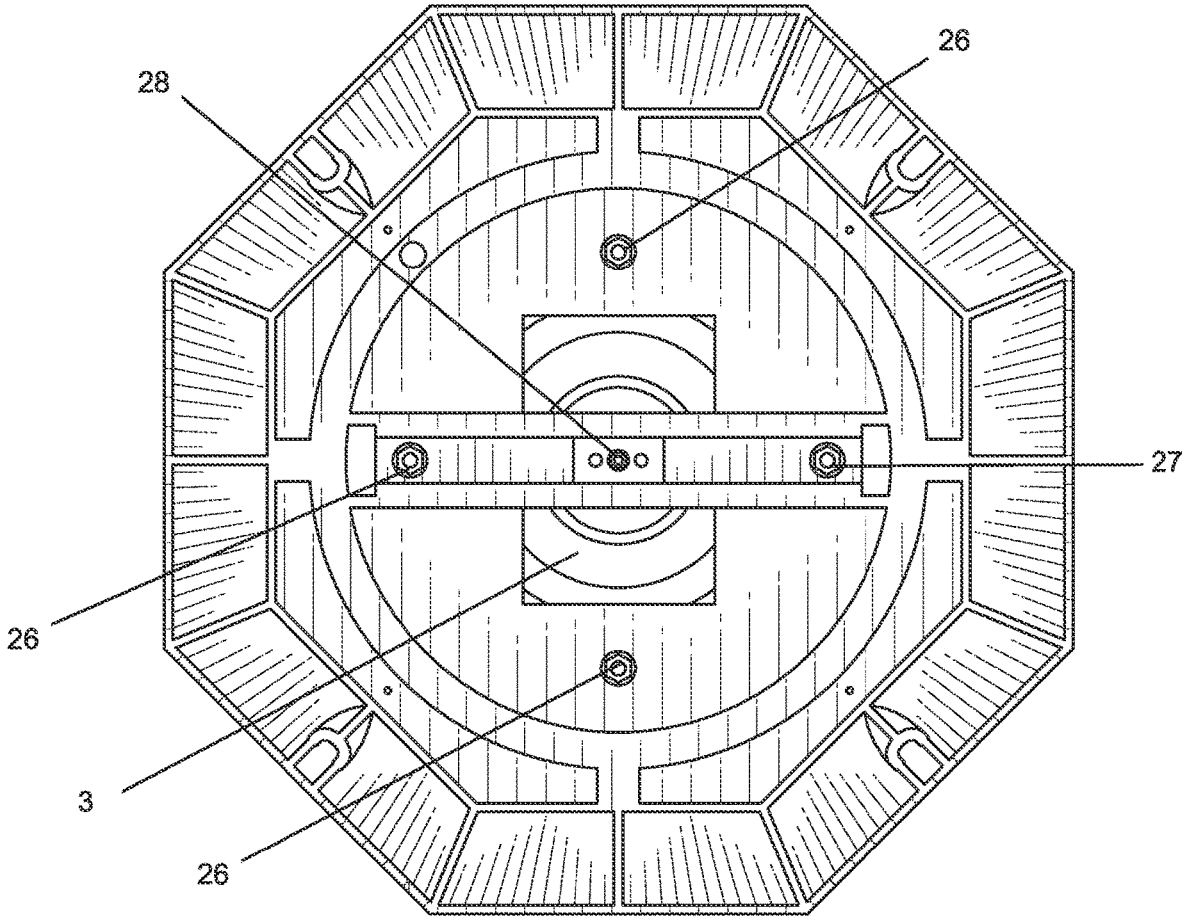
FIG. 12—is a bottom view of a base and a recoil joint anchor in one embodiment thereof.

As shown in FIGS. 9 and 11-12, a circumferential weight (9) may be secured to the flexible boot (3) and/or the base (2) through one or a plurality of fasteners (26). In this embodiment, the circumferential weight (9) may provide an equally distributed counterweight to resist the force placed on an extension arm when used for batting practice or the like and to maintain the base (2) in a stationary location. It should be noted that in certain other embodiments, a circumferential weight (9) may include a plurality of non-continuous weighted elements that may be placed in an opposing configuration and further secured to the flexible boot (3) and/or base (2) through, again one or more fasteners (26).

The invention may include a receiver tube (4) positioned within a flexible boot (3) through an aperture (31). Generally referring to FIGS. 1-2, the receiver tube (4) may be positioned to be secured internally within the flexible boot with a portion extending beyond the flexible boot's (3) top surface. In this embodiment, the receiver tube (4) may be further configured to secure one or more extension arms (5). Again referring to FIGS. 1-2, and 8, a plurality of extension arms (5) may be coupled in a telescoping configuration such that an extension arm may be extended or retracted along an approximately vertical orientation. One or more extension arm couplers (6) may be positioned so as to secure one or more telescoping extension arms (5). In this manner, a user may adjust the telescoping extension arms (5) into an optimal or desired height when operating the tee.

Figure 10:
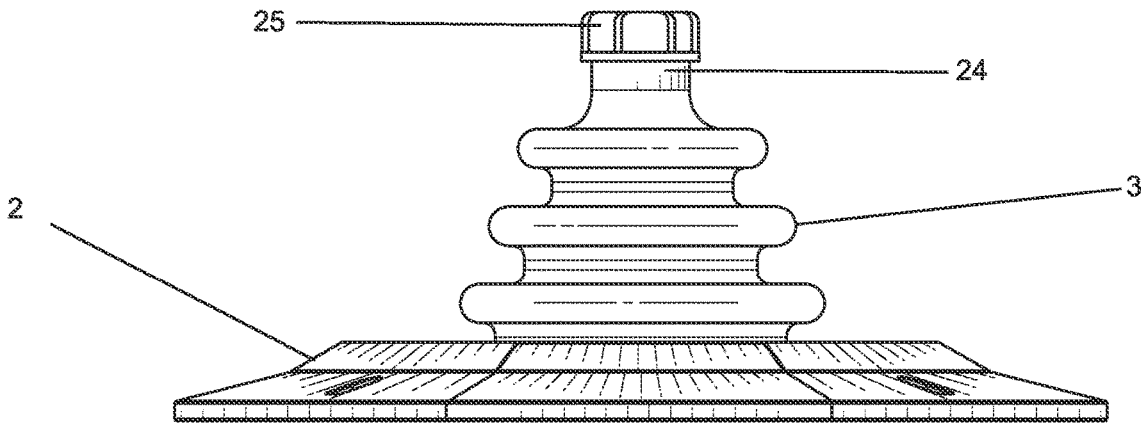
FIG. 10—is a side view of a base and flexible boot as well as an extension arm lock and corresponding receiver tube lock in a coupled configuration in one embodiment thereof.

The invention may also include a lock configured to secure an extension arm (5) to the receiver tube (4). Referring to FIGS. 9-11, in one embodiment, a receiver tube lock (24) may be configured to be coupled with an extension arm lock (25). In the preferred embodiment, a receiver tube lock (24) may include a twist lock that may further be integral with the top end of the receiver tube (4) and may further be configured to extend above the flexible boot (3). A extension arm lock (25) may be slidably coupled with the extension arm (5) and configured to be secured to the receiver tube lock (24), for example in a twist lock configuration. In this embodiment, the twist lock coupling of the extension arm lock (25) and receiver tube lock (24) may include a quick release tab for easy decoupling and disassembly. Additional embodiments of the invention may include a variety of locks that may secure an extension arm (5) to a receiver tube (6). For example, certain embodiments may include a fitted locking mechanism, while alternative embodiments may include a slide locking mechanism, a pin-locking mechanism, a beveled locking mechanism and the like.

Figure 1:
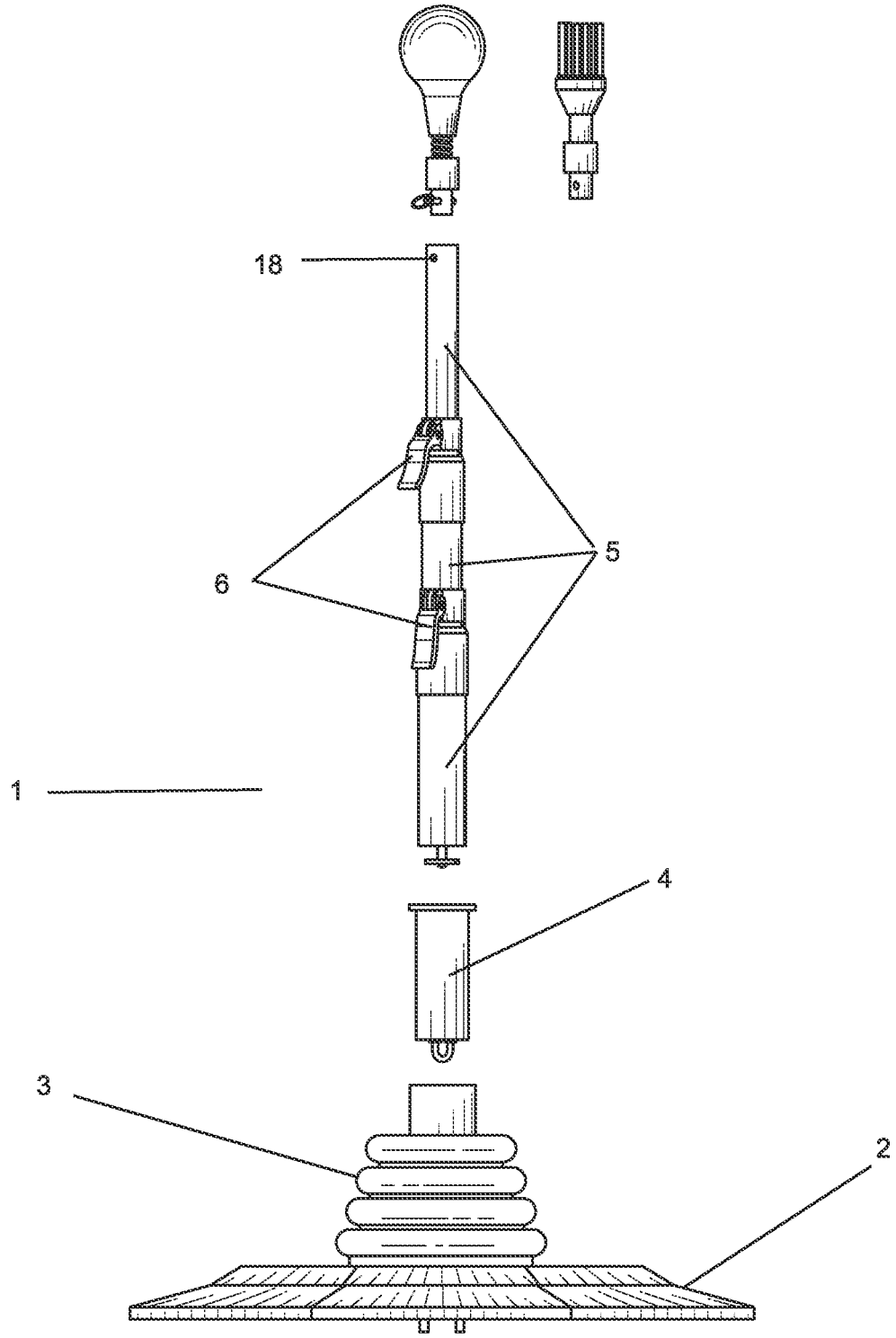
FIG. 1—is a front view of modular self-returning batting tee with exemplary modular batting attachments in one embodiment thereof.
Figure 2:
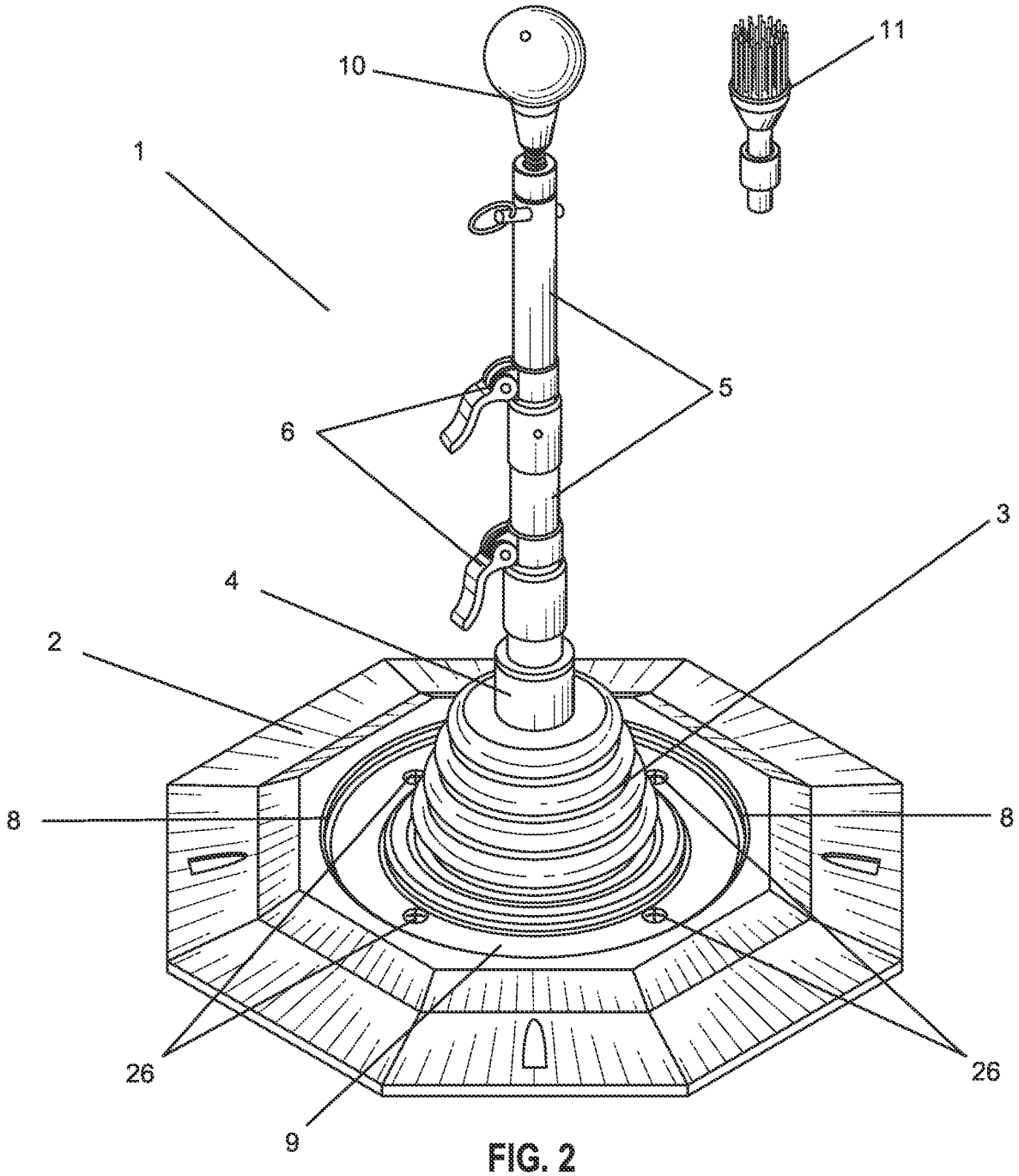
FIG. 2—is a perspective view of modular self-returning batting tee coupled with a modular ball attachment in one embodiment thereof.
Figure 3:
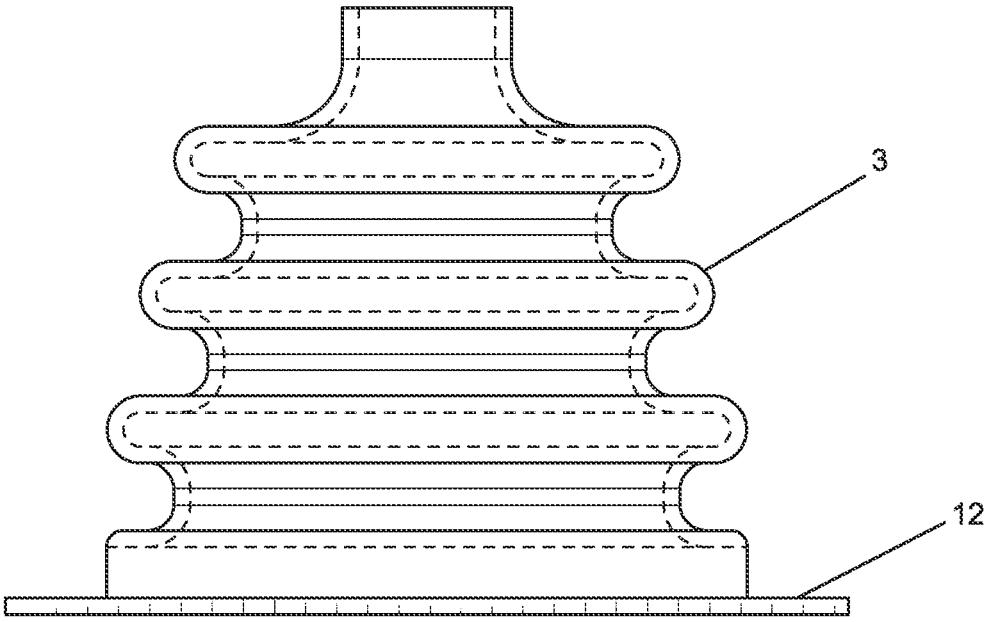
FIG. 3—is a front view of a flexible boot in one embodiment thereof.
Figure 4:
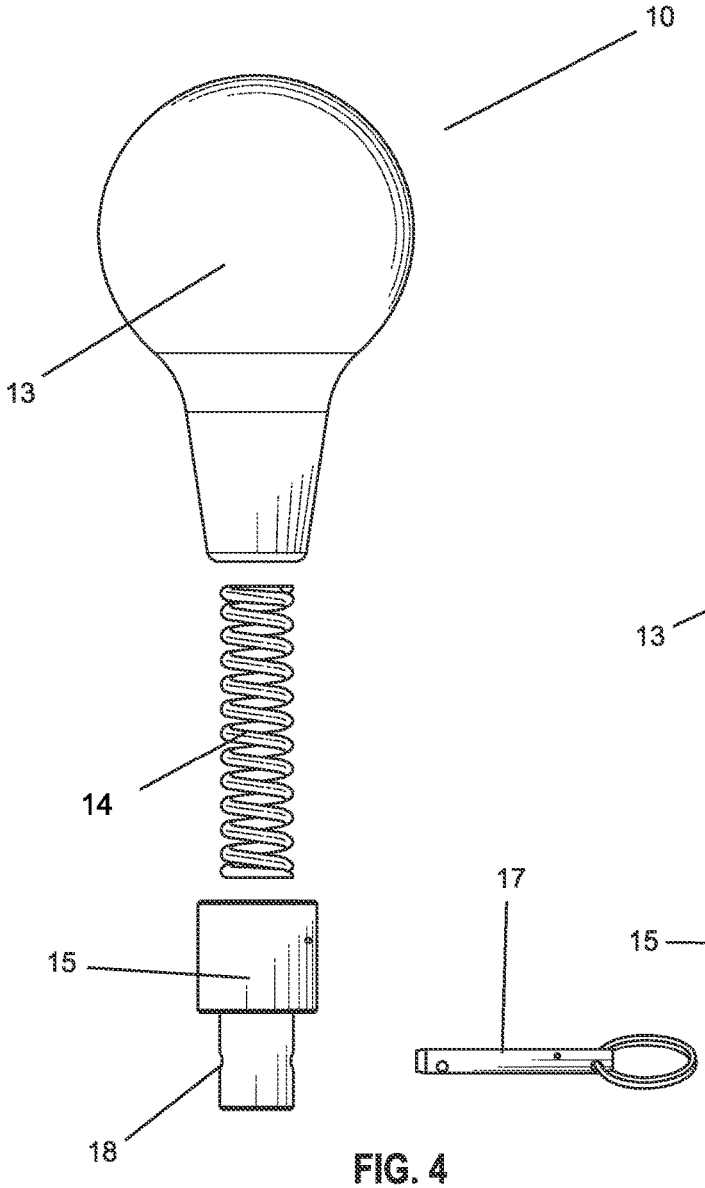
FIG. 4—is a front view of a fully-disarticulated modular ball attachment in one embodiment thereof.
Figure 5:
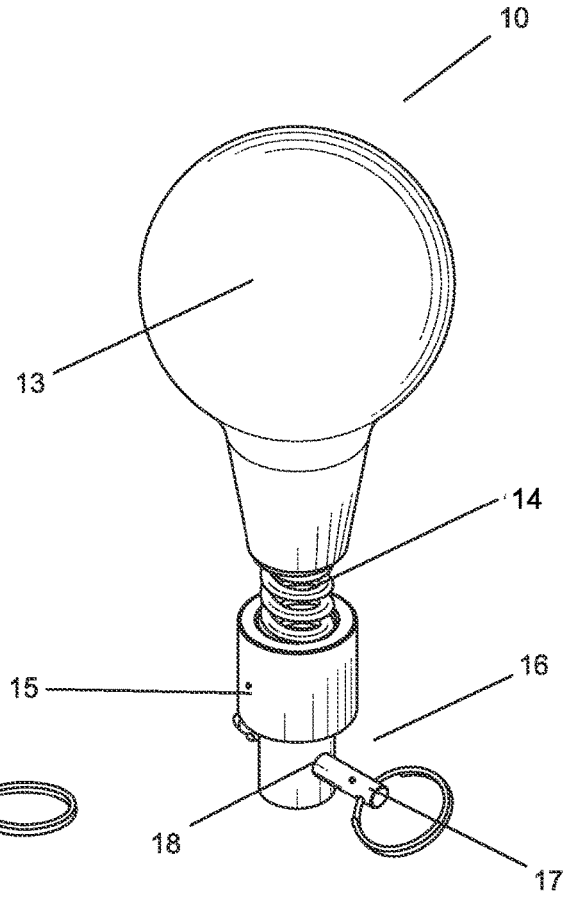
FIG. 5—is a perspective view of a partially-disarticulated modular ball attachment in one embodiment thereof.
Figure 6:
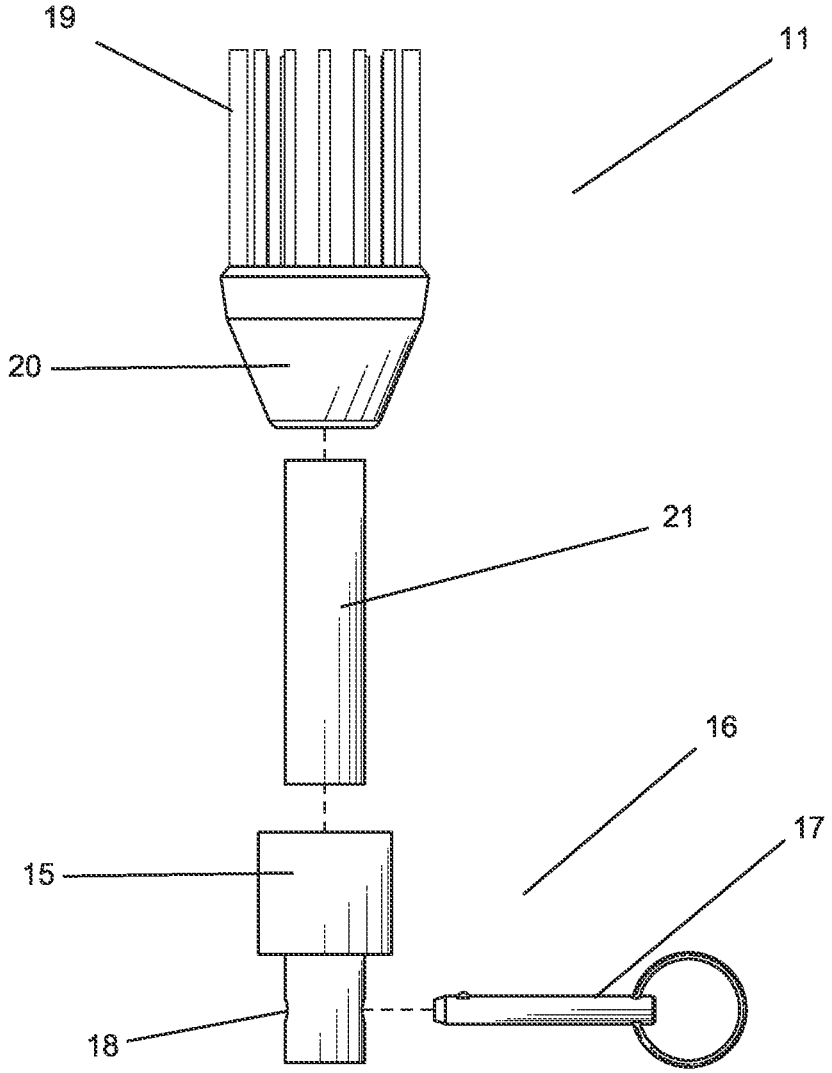
FIG. 6—is a front view of a fully-disarticulated modular brush attachment in one embodiment thereof.
Figure 7:
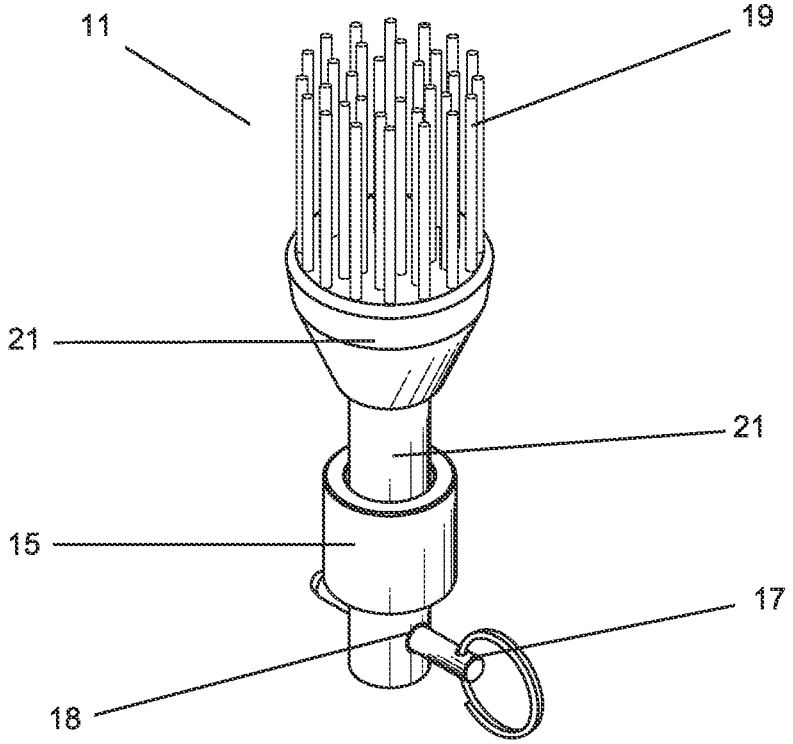
FIG. 7—is a perspective view of a modular ball attachment in one embodiment thereof.
Figure 8:
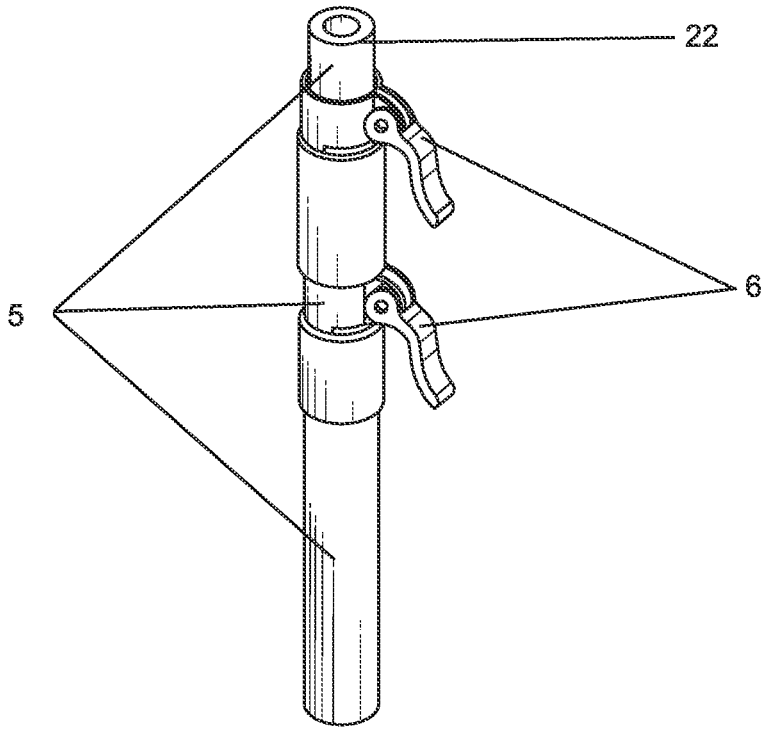
FIG. 8—is a plurality of extension arms in a telescoping configuration made securable with two extension arm couplers.

In certain embodiment, a ball, such as a baseball or softball maybe positioned atop an extension arm. As shown in FIG. 8, in a preferred embodiment, a distal extension arm (5) may include a mount receiver (22) configured to secure one or more modular attachments. As shown in FIG. 1, a modular attachment may be fitted over a mount receiver (22) on the terminal end of an extension arm (5). A modular attachment may further be secured to a mount receiver (22) through a mount lock (16). In a preferred embodiment, this mount lock may include a pin (17) configured to be pass through apertures (18) on said mount receiver (22) and a mount (15) on a modular attachment, as shown in FIG. 2. It should be noted that this preferred embodiment is exemplary only, as a variety of lock and locking mechanisms may be contemplated within the scope of the invention. For example, in certain embodiments a mount lock (16) may include a snap-lock, a slide lock, a beveled lock and/or a quick release lock, to name a few non-limiting examples.

As noted above, the invention may include a variety of modular attachments that may be interchangeably coupled to an extension arm (5). Referring now to FIGS. 1-2 and 4-5, in a preferred embodiment, the invention may include a modular ball attachment (10). In this embodiment, a modular ball attachment (10) may include a self-recoiling ball (13) that is configured to be struck by a bat and mimic the approximate weight and density of a baseball or softball. As shown in the figures, a self-recoiling ball (13) may be coupled with a mount (15), preferably with a spring or other flexible component. In certain embodiment, the spring (14) may be covered by a protective sleeve (42), such as a rubber tube that may cover any exposed spring surface extending from the lower portion of the self-recoiling ball (13) to the mount (15). In alternative embodiment, the spring may be full inserted and secured within the mount (15).

In this configuration, when struck, for example by a bat, the self-recoiling ball (13) may be allowed to flex through the action of the spring (14) and thus redirect the transfer of energy from the self-recoiling ball (13) and into the extension arm. In this manner the self-recoiling ball (13) may further prevent the forward kinetic energy of a swinging bat from being transferred into the extension arm (5) and base (2) which may cause the device to move and/or tip over.

Figure 13:
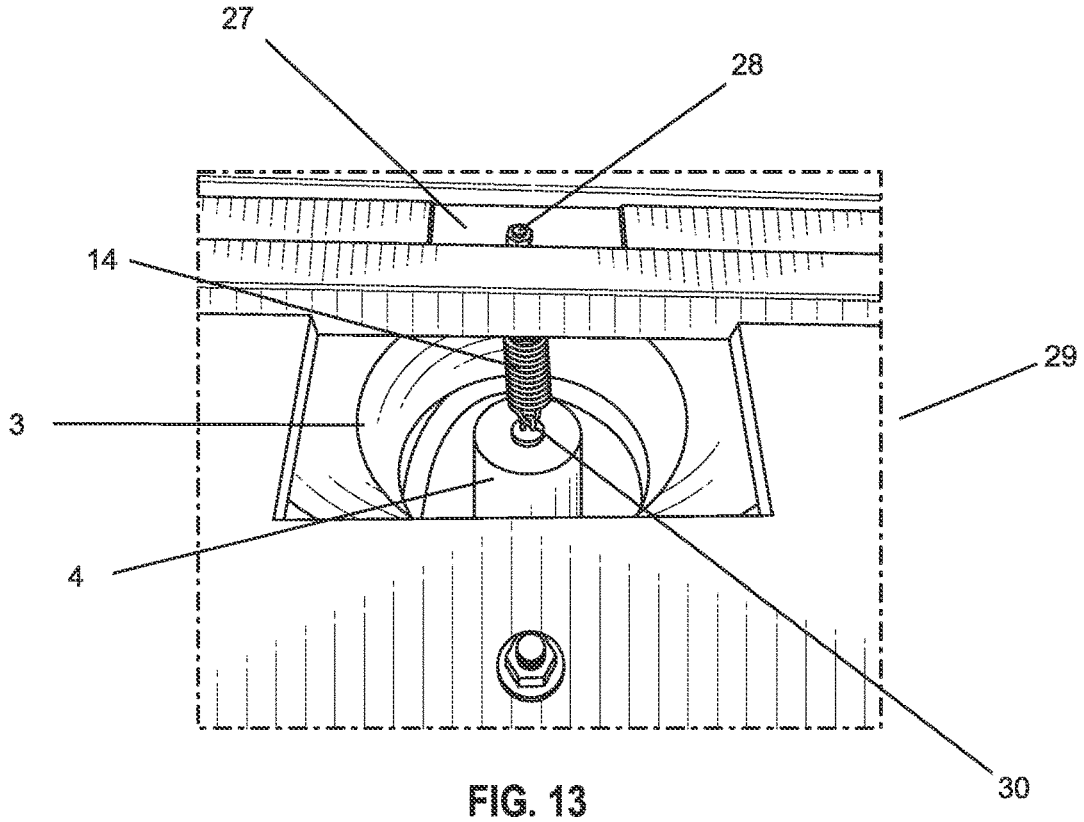
FIG. 13—is an expanded view of a recoil joint in one embodiment thereof.
Figure 14:
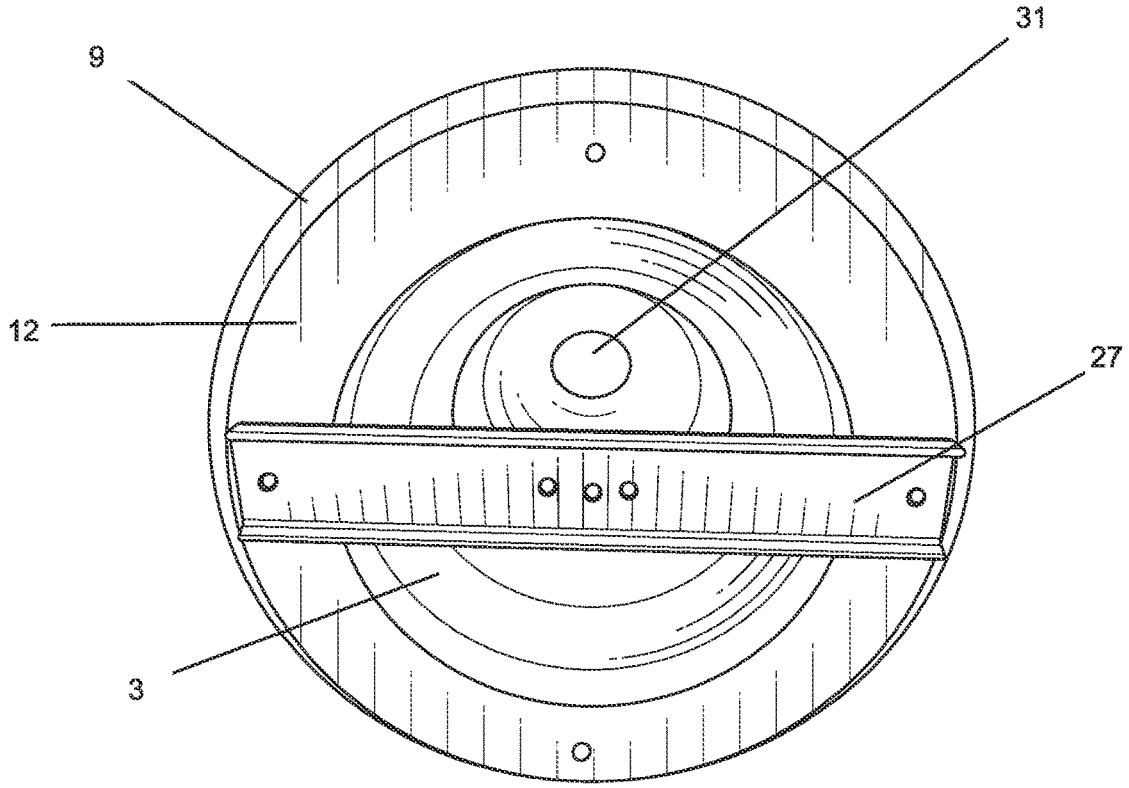
FIG. 14—is an isolated view of a flexible boot and anchor bar in one embodiment thereof.
Figure 15:
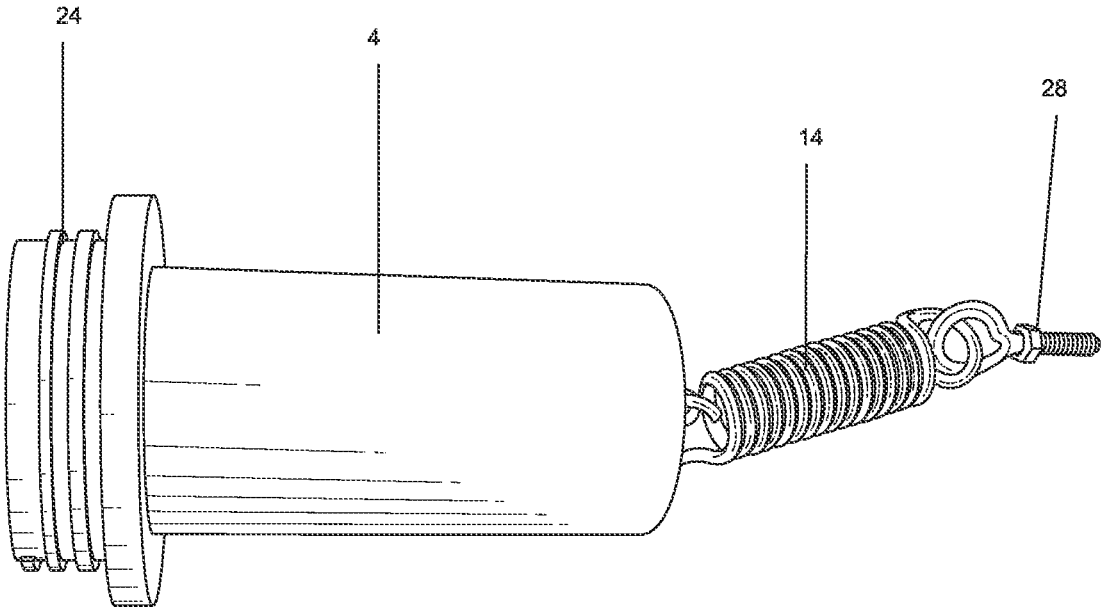
FIG. 15—is an isolated view of a receiver tube in one embodiment thereof.
Figure 16:
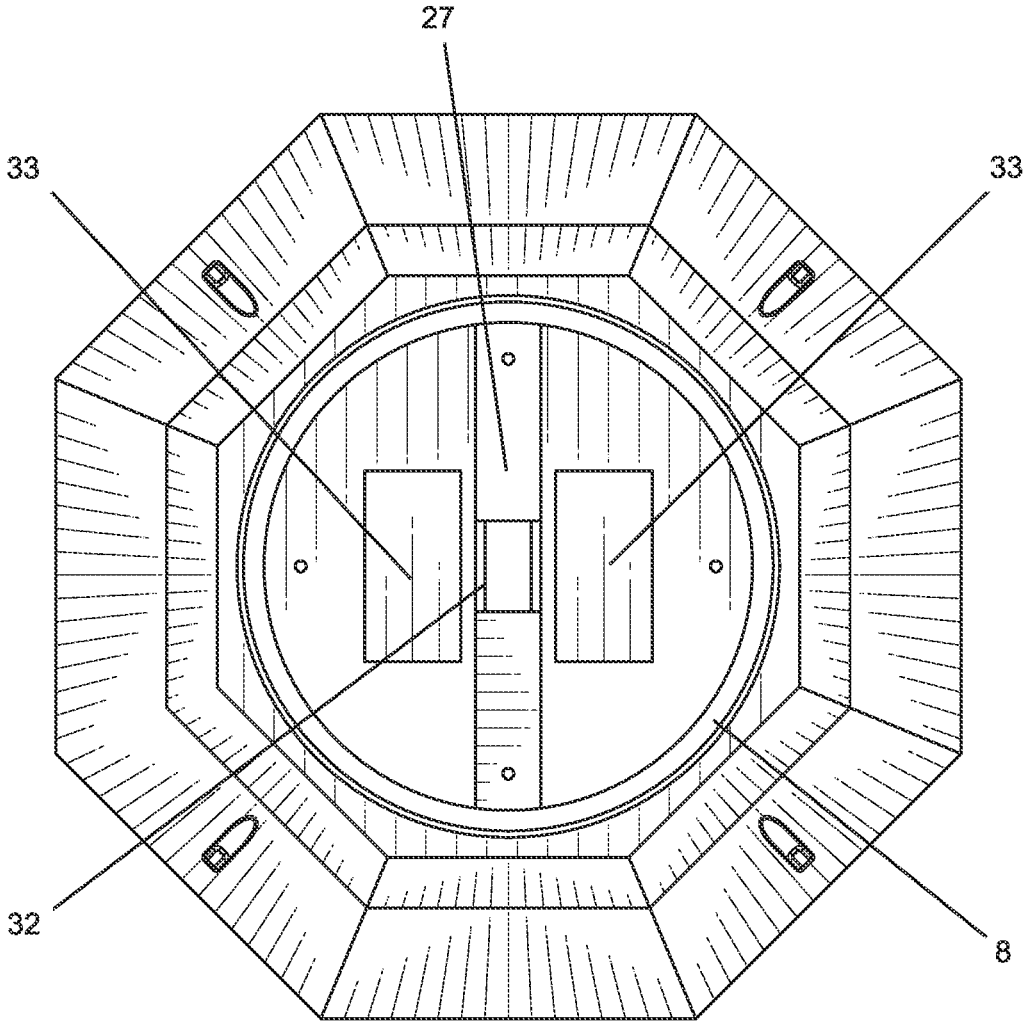
FIG. 16—is a top view of an isolated base showing an anchor bar positioned in an anchor bar channel in one embodiment thereof.

As shown in FIGS. 13 and 15, the spring (14) of the invention may be in an "open" or "non-encased" configuration. In this embodiment, the spring configured to be open to the external environment and not immediately surrounded by one or more components that would need to be removed to expose the spring.

Referring to FIGS. 1-2, and 6-7, in a preferred embodiment, the invention may include a modular brush attachment (11). In this embodiment, a modular brush attachment (11) may include a rigid brush (19) composed of a plurality of rigid spines configured to support a baseball or softball that may further be embedded in a rigid brush support (20). As shown in figured 6, a rigid brush support (20) may be linked to a mount (15) through a rigid linker (21). In certain embodiment, this rigid linker may be hinged and/or spring-loaded such that it may flex in a similar fashion to the modular ball attachment (10) described above.

Figure 17:
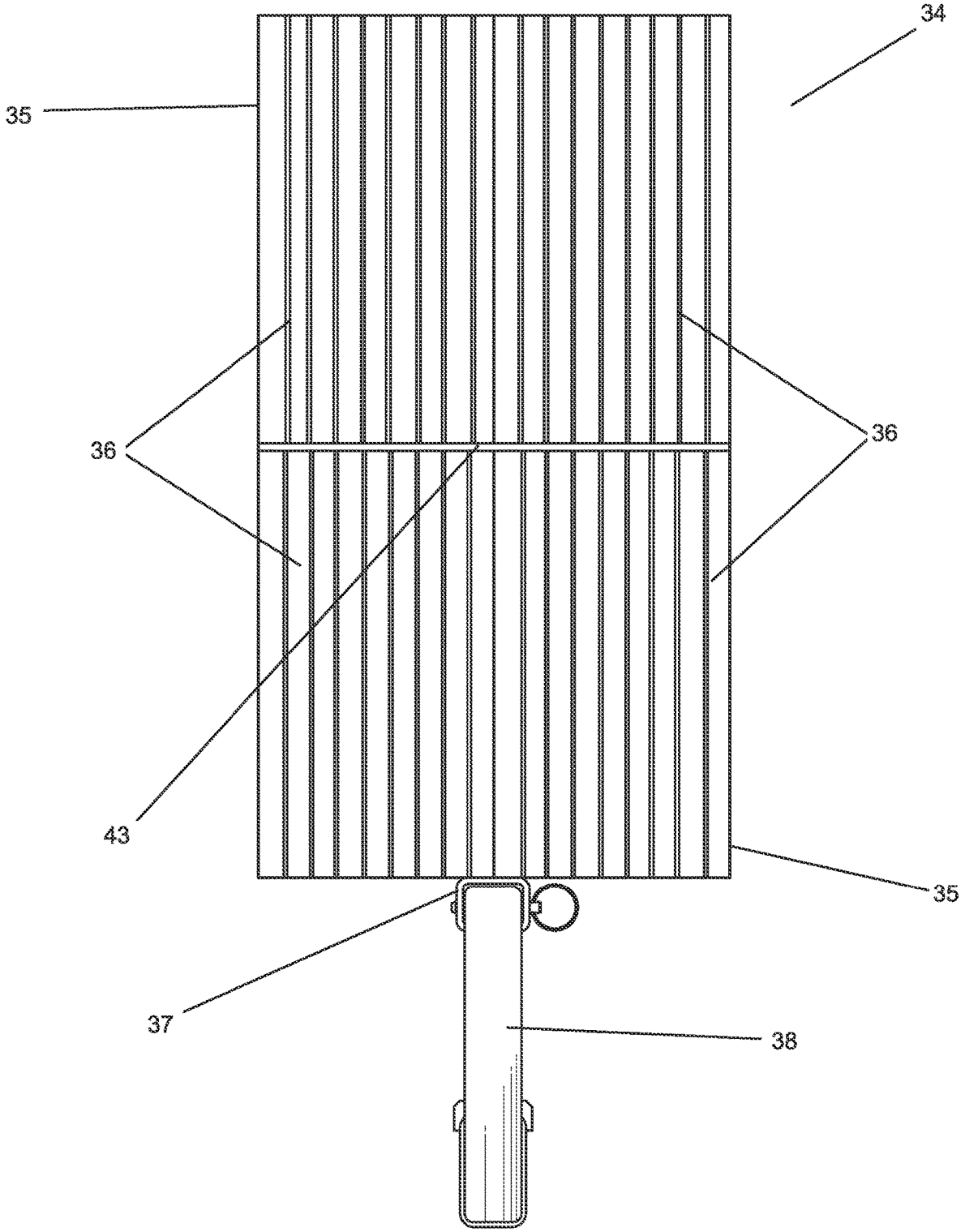
FIG. 17—is a modular pitching attachment having four pitching partitions in one embodiment thereof.
Figure 18:
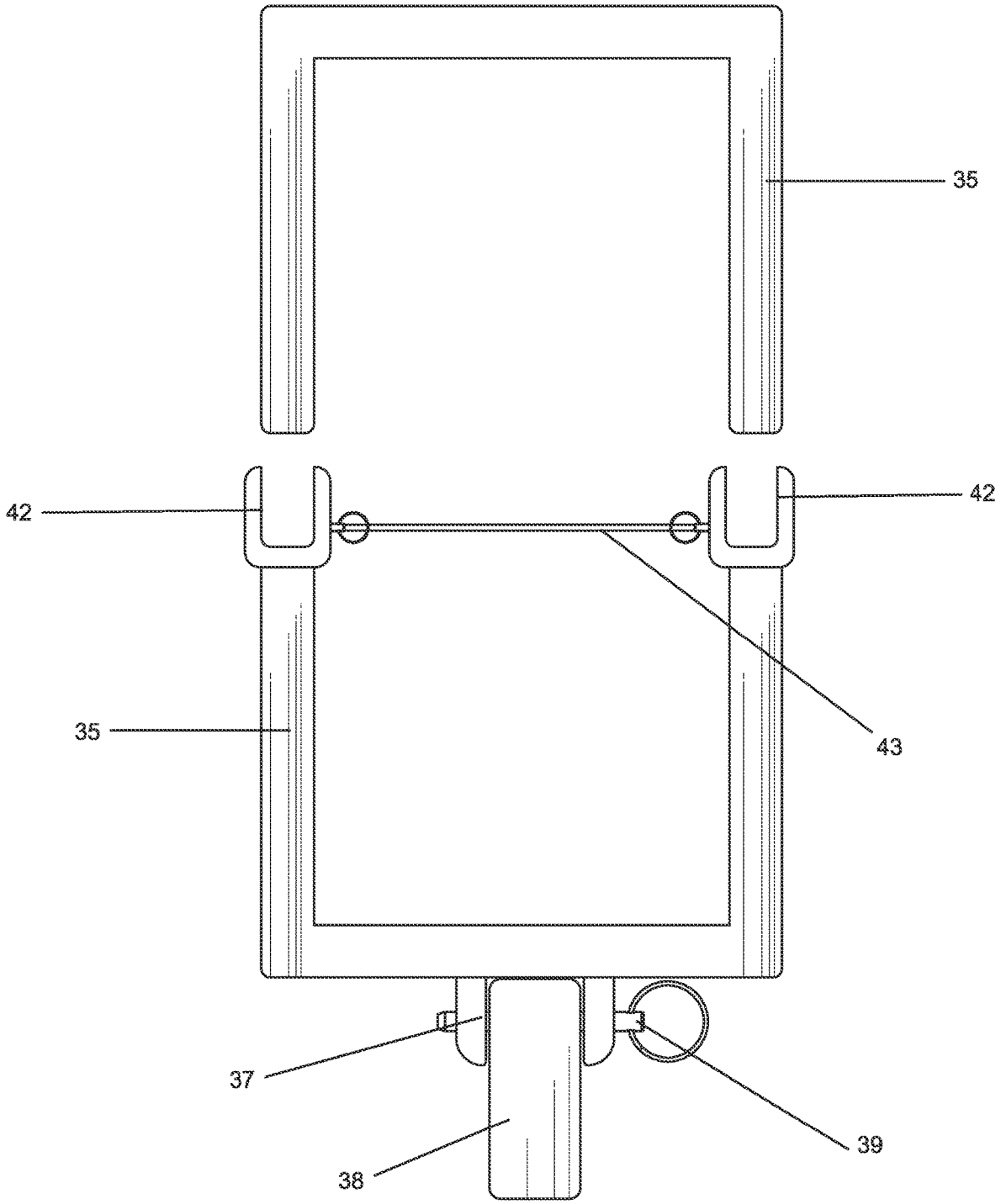
FIG. 18—is a modular pitching attachment in one embodiment thereof.
Figure 19:
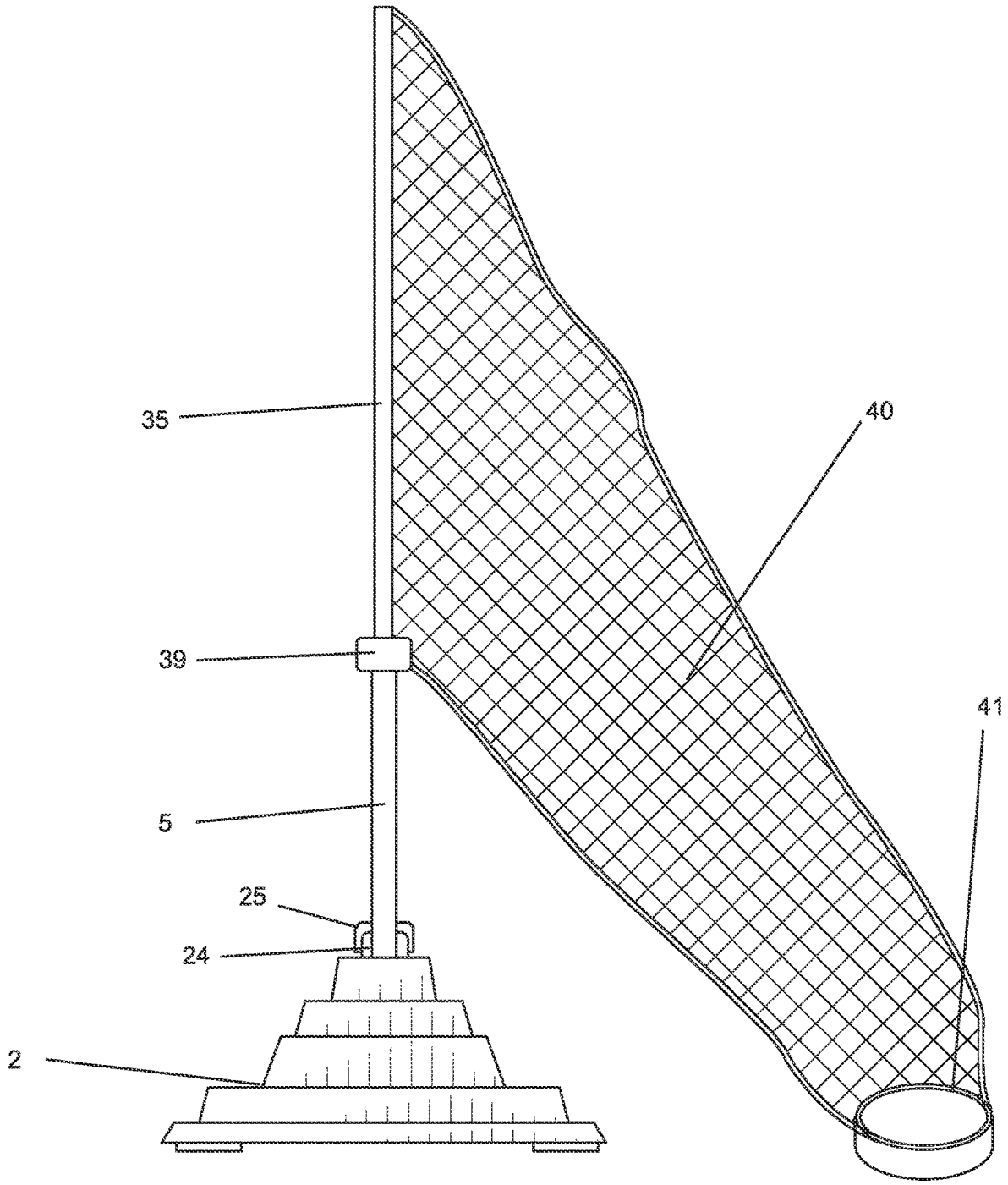
FIG. 19—is a modular self-returning tee coupled with a modular pitching attachment having a tapered net in one embodiment thereof.

In one embodiment, the invention may include a modular pitching attachment (34) that may be coupled with a modular self-returning batting tee (1). Referring now to FIGS. 17-19, in one preferred embodiment, a support arm (38) may be secured in a receiver tube (4) and maintained in an approximately vertical position by a frame lock (39). This support arm (38) may further have a lock that may be used to secure it to a receiver tube or other component. In such a preferred embodiment, a receiver tube lock (24) may be configured to be coupled with an extension arm lock (25) that is slidably attached with a support arm (38), as generally described above and demonstrated in FIG. 19.

Again referring to FIGS. 17-19, a support arm (38) may be coupled with, and support, a pitching frame (35). This pitching frame (35) may be in the approximate size and shape of a hypothetical "strike-zone." Additional sizes and configurations may also be included in the invention. As shown in FIG. 17-18, in one embodiment this pitching frame (35) may be a unitary component, or may be comprised of several separate components that may be interlocked together with a frame coupler (37) to form the generalized shape of the frame's dimensions. Additionally, a cross-support (43) may be attached to the pitching frame (35), which as shown in FIG. 18, may preferably be along the approximate midline of the pitching frame (35). This cross-support may be a flexible component, such as a nylon cord which can be attached and or detached when the pitching-frame is broken down.

As demonstrated in FIG. 17, the invention may include a plurality of pitching partitions (36). Such partitions may approximately encompass typical quadrants of a strike zone. In a preferred embodiment, a pitching partition (36) may include four quadrants, specifically: 1) the upper and lower half of a hypothetical strike zone; as well as 2) the inside and outside portions of a hypothetical strike zone. These quadrants may be delineated by color-coded or other material coupled with the pitching frame (35). Again, as shown in FIG. 19, each quadrant may be delineated by a series of color strips of material secured to the pitching frame (35) or cross-support (43). In this preferred embodiment, during a typical pitching practice, a user will throw the ball through the pitching frame (35). When a thrown ball passes through one of the pitch partitions (36) it may disturb the colored strips providing a visual indication of the pitch's placement within the hypothetical strike zone. As shown in FIG. 19, in another embodiment a tapered net (40) may be secured to the pitching frame (35) such that a ball that passes through the hypothetical strike zone may be collected by the net. In yet a further embodiment, this net may include a net weight, or preferably an integral net weight (41) such as a weighted rope or other flexible weighted material that may form part of the net, interwoven with the net or otherwise coupled with the net. In this embodiment, the net weight (41) provides sufficient resistance to prevent the momentum of the ball from pushing the net too far in one direction and thereby pulling on, or tipping the pitching frame (35), and also provides a collection point for the ball.

The invention may further include a recoil joint (29). As generally shown in FIGS. 12-16, in one preferred embodiment a recoil joint (29) may couple a receiver tube (4)—which may further be securing an extension arm (5)—with the base (2) of a modular self-returning batting tee (1). In this manner, when a batter swings to hit, for example, a modular ball attachment (10) the momentum of the swing will force the extension arm (5) to bend forward. The resistance from the flexible boot (3) may provide resistance to this bend as well as an opposing force to return the extension arm to its approximately vertical position. Similarly, the recoil joint (29) may anchor the receiver tube (4), and by extension the attached extension arm to the tee's weighted base (2), as well as provide an opposing force to facilitate the return of the receiver tube (4) and extension arm (5) to an approximately upright position.

As shown in FIGS. 13 and 15, in one embodiment a recoil joint (29) may include a receiver tube attachment (30) that may anchor a spring (14)—or spring-like device, such as an elastic band and the like. In a preferred embodiment, a spring (14) or spring-like elastic component may be secured to the base (2) through a recoil joint anchor (28). In the preferred embodiment shown in FIG. 13, a spring (14) or spring-like elastic component may be secured to an anchor bar (27) that may further be positioned within an anchor bar channel (32) on the base (2). Here, the anchor bar may form a strong base for the action of the recoil joint (29). In a preferred embodiment, this anchor bar (27) may be formed of a metal, hard-plastic material, or other composite material. It should be noted that in the embodiments shown in the figures, the recoil joint anchor (28) may include a threaded secret and nut configuration. This configuration is exemplary only, as additional types of anchors, fasteners and/or couplers may be included with the invention. As noted in FIGS. 13 and 33, in this embodiment a base (2) may include one or more access panels (33) that may allow a user to access, for example the recoil joint (29) for repair, replacement or to remove when breaking down the modular tee.

With respect to this recoil joint (29) and the overall return function of the modular tee (1), taken in sequence, a batter may, for example, strike a modular ball attachment (10) causing the receiver tube (4) and extension arm (5) to bend forward, whereby the forward momentum of the receiver tube (4) and/or extension arm (5) is dissipated by the individual and/or collective action of the flexible boot (3) and/or recoil joint (29). At a certain point, the forward momentum of the receiver tube (4) and/or extension arm (5) is fully-dissipated, such that the opposing force of the flexible boot (3) and/or recoil joint (29) may pull the receiver tube (4) and/or extension arm (5) back to an approximately upright position. In this manner, the components of the modular batting tee work together to cause the return of the extension arm. This return may reset the batting tee, such that a user may re-load and execute another swing, whereby the process of the extension arm return is repeated.

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, techniques as well as devices to accomplish a modular self-returning batting tee system and the like. In this application, the methods and apparatus for the aforementioned system are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the statements of invention. As can be easily understood from the foregoing, the basic concepts of the present invention may be embodied in a variety of ways. It involves both techniques as well as devices to accomplish the appropriate system. In this application, the techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in method-oriented terminology, each element of the claims corresponds to a device. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effective disclosure of the act of "coupling", such a disclosure should be understood to encompass disclosure of a "coupling method and/or technique, and/or coupler device." Such changes and alternative terms are to be understood to be explicitly included in the description.

Any patents, publications, or other references mentioned in this application for patent, such as in the specification or an IDS, are hereby incorporated herein by reference in their entirety. Any priority case(s) claimed by this application is hereby appended and hereby incorporated herein by reference in their entirety. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated herein by reference in their entirety. Finally, all references listed in the list of References To Be Incorporated By Reference In Accordance With The Patent Application or other information disclosure statement and the like filed with the application are hereby appended and hereby incorporated herein by reference in their entirety, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the methods and/or apparatus for providing a modular self-returning batting tee system as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in the potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this application also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The inventive subject matter is to include, but certainly not be limited as, a system substantially as herein described with reference to any one or more of the Figures and Description (including the following: for example, the process according to any claims and further comprising any of the steps as shown in any Figures, separately, in any combination or permutation).

What is claimed is:

1. A modular self-returning batting tee device comprising: —a base; —a flexible boot having a rigid profile comprising a series of extended progressively larger compression positions configured provide a compression force resistance, store energy of a bat struck by a user, and re-direct said energy as an opposing return force to at least one extension arm when struck by said user; —a receiver tube positioned within said flexible boot through a flexible boot aperture and further configured to be coupled with said at least one extension arm; —a modular attachment; —at least one circumferential weight positioned around said flexible boot and secured to said base through a plurality of fasteners; —an extension arm lock configured to be secured to a receiver tube lock and secure said at least one extension arm to said receiver tube positioned within said flexible boot; —at least one open recoil joint comprising: —a receiver tube attachment; —a non-encased spring attached to said receiver tube attachment wherein said spring is configured to be open to an external environment and, wherein a body of said spring is not in contact with one or more components of the device when stationary or when stretched, and wherein a user can access and disengage the recoil joint; —a recoil joint anchor securing said non-encased spring to an anchor bar; and—an anchor bar channel configured to hold said anchor bar.

2. A modular self-returning batting tee as described in claim 1 wherein said modular attachment comprises a modular attachment selected from the group consisting of:

a modular brush attachment configured to be secured to a terminal end of said at least one extension arm;

a modular ball attachment configured to be secured to the terminal end of said at least one extension arm; and a modular pitching attachment.

3. A modular self-returning batting tee as described in claim 2 wherein said modular brush attachment configured to be secured to the terminal end of said at least one extension arm further comprises modular brush attachment having:

a rigid brush support securing a plurality of rigid brushes configured to support a ball; and a rigid linker attached to a mount wherein said mount is configured to be coupled with the terminal end of said at least one extension arm with a mount coupler.

4. A modular self-returning batting tee as described in claim 2 wherein said modular ball attachment configured to be secured to the terminal end of said at least one extension arm comprises modular ball attachment having:

a self-recoiling ball having an internally positioned spring; and a mount securing said spring wherein said mount is configured to be coupled with the terminal end of said at least one extension arm with a mount coupler.

5. A modular self-returning batting tee as described in claim 2 wherein said modular pitching attachment comprises a modular pitching attachment having:

a pitching frame supporting a plurality of pitching partitions; and a frame coupler configured to be coupled with a support arm and/or an extension arm through a frame lock wherein said support arm is further configured to be coupled with said receiver tube positioned within said flexible boot through a flexible boot aperture.

6. A modular self-returning batting tee as described in claim 2 wherein said at least one extension arm configured to be coupled with said receiver tube comprises a plurality of interlocking extension arms positioned in a telescoping configuration.

7. A modular self-returning batting tee as described in claim 6 and further comprising at least one extension arm coupler configured to secure said plurality of interlocking extension arms positioned in a telescoping configuration.

8. A modular self-returning batting tee as described in claim 7 wherein said receiver tube lock comprises a receiver tube lock configured to be integral with said receiver tube positioned within said flexible boot through a flexible boot aperture.

9. A modular self-returning batting tee as described in claim 8 and further comprising at least one access panel on said base.

10. A modular self-returning batting tee as described in claim 9 and further comprising a base extension configured to be secured with said circumferential weight positioned around said flexible boot and secured to said base through a plurality of fasteners.

11. A modular self-returning batting tee as described in claim 10 and further comprising a plurality of stake apertures on said base.

12. A modular self-returning batting tee as described in claim 7 wherein said extension arm comprises an extension arm having a mount receiver at its terminal end configured to secure at least one modular attachment with a mount lock.

13. A self-returning batting tee comprising: —a base; —a flexible boot configured to be positioned on said base and configured to provide a force resistance, store energy of a bat struck by a user, and re-direct said energy as an opposing return force to at least one extension arm when struck by said user; —a receiver tube positioned within said flexible boot through a flexible boot aperture and further configured to be coupled with said at least one extension arm, and wherein said at least one extension arm configured to be coupled with said receiver tube and further configured to secure at least one ball; —at least one circumferential weight positioned around said flexible boot and secured to said base through a plurality of fasteners; —an extension arm lock configured to be secured to a receiver tube lock and secure said at least one extension arm to said receiver tube positioned within said flexible boot; —at least one open recoil joint comprising: —a receiver tube attachment; —a non-encased spring attached to said receiver tube attachment wherein said spring is configured to be open to an external environment and, wherein a body of said spring is not in contact with one or more components of the device when stationary or when stretched, and wherein a user can access and disengage the recoil joint; —a recoil joint anchor securing said non-encased spring to an anchor bar; and—an anchor bar channel configured to hold said anchor bar.

14. A self-returning batting tee as described in claim 13 wherein said at least one extension arm configured to be coupled with said receiver tube comprises a plurality of interlocking extension arms positioned in a telescoping configuration.

15. A self-returning batting tee as described in claim 14 and further comprising at least one extension arm coupler configured to secure said plurality of interlocking extension arms positioned in a telescoping configuration.

16. A self-returning batting tee as described in claim 15 wherein said receiver tube lock comprises a receiver tube lock configured to be integral with said receiver tube positioned within said flexible boot through a flexible boot aperture.

17. A self-returning batting tee as described in claim 16 wherein said at least one extension arm comprises at least one extension arm having a mount receiver at a terminal end configured to secure at least one modular attachment with a mount lock.

18. A self-returning batting tee as described in claim 17 wherein said modular attachment comprises a modular attachment selected from the group consisting of:

a modular brush attachment configured to be secured to the terminal end of said at least one extension arm;

a modular ball attachment configured to be secured to the terminal end of said at least one extension arm; and a modular pitching attachment.

19. A self-returning batting tee as described in claim 18 wherein said modular brush attachment configured to be secured to the terminal end of said at least one extension arm further comprises modular brush attachment having:

a rigid brush support securing a plurality of rigid brushes configured to support a ball; and a rigid linker attached to a mount wherein said mount is configured to be coupled with the terminal end of said at least one extension arm with a mount coupler.

20. A self-returning batting tee as described in claim 18 wherein said modular ball attachment configured to be secured to the terminal end of said at least one extension arm comprises modular ball attachment having:

a self-recoiling ball having an internally positioned spring; and a mount securing said spring wherein said mount is configured to be coupled with the terminal end of said at least one extension arm with a mount coupler.

21. A self-returning batting tee as described in claim 18 wherein said modular pitching attachment comprises a modular pitching attachment having:

a pitching frame supporting a plurality of pitching partitions; and a frame coupler configured to be coupled with a support arm and/or an extension arm through a frame lock wherein said support arm is further configured to be coupled with said receiver tube positioned within said flexible boot through a flexible boot aperture.

22. A modular batting tee comprising: —a base; —a flexible boot having a rigid profile comprising a series of extended progressively larger compression positions configured provide a compression force resistance, store energy of a bat struck by a user, and re-direct said energy as an opposing return force to at least one extension arm when struck by said user; —a receiver tube positioned within said flexible boot through a flexible boot aperture and further configured to be coupled with said at least one extension arm; —at least one modular attachment configured to be secured to a terminal end of said at least one extension arm and replaced based on a user's preference, wherein said modular attachment is selected from the group consisting of: —a modular brush attachment; —a modular ball attachment; and—a modular pitching attachment; —at least one circumferential weight positioned around said flexible boot and secured to said base through a plurality of fasteners; and—an extension arm lock configured to be secured to a receiver tube lock and secure said at least one extension arm to said receiver tube positioned within said flexible boot; and—at least one open recoil joint comprising: —a receiver tube attachment, —a non-encased spring attached to said receiver tube attachment wherein said spring is configured to be open to an external environment and, wherein the body of said spring is not in contact with one or more components of the device when stationary or when stretched, and wherein a user can access and disengage the recoil joint.

23. A modular batting tee as described in claim 22 wherein said at least one extension arm configured to be coupled with said receiver tube comprises a plurality of interlocking extension arms positioned in a telescoping configuration.

24. A modular batting tee as described in claim 23 and further comprising at least one extension arm coupler configured to secure said plurality of interlocking extension arms positioned in a telescoping configuration.

25. A modular batting tee as described in claim 24 wherein said extension arm comprises an extension arm having a mount receiver at its terminal end configured to secure at least one modular attachment with a mount lock.

26. A modular batting tee as described in claim 24 wherein said modular brush attachment is configured to be secured to the terminal end of said at least one extension arm and further comprises a modular brush attachment having:

a rigid brush support securing a plurality of rigid brushes configured to support a ball; and a rigid linker attached to a mount wherein said mount is configured to be coupled with the terminal end of said at least one extension arm with a mount coupler.

27. A modular batting tee as described in claim 24 wherein said modular ball attachment is configured to be secured to the terminal end of said at least one extension arm comprises modular ball attachment having:

a self-recoiling ball having an internally positioned spring; and a mount securing said spring wherein said mount is configured to be coupled with the terminal end of said at least one extension arm with a mount coupler.

28. A modular batting tee as described in claim 22, wherein said modular pitching attachment comprises a modular pitching attachment having: —a pitching frame supporting a plurality of pitching partitions; and—a frame coupler configured to be coupled with a support arm and/or an extension arm through a frame lock wherein said support arm is further configured to be coupled with said receiver tube positioned within said flexible boot through a flexible boot aperture.

* * * * *